United States Patent [19]

Drouin

[11] 4,060,069

[45] Nov. 29, 1977

[54] WINDOW UNIT FOR USE IN OVEN DOORS

[75] Inventor: Claude Drouin, Ste-Julie, Canada

[73] Assignee: Les Industries BFG Limitee, Montmagny, Canada

[21] Appl. No.: 676,874

[22] Filed: Apr. 14, 1976

[30] Foreign Application Priority Data

Apr. 12, 1976 Canada ..... 250042

[51] Int. Cl.[2] ..... F23M 7/00

[52] U.S. Cl. ..... 126/200; 52/656

[58] Field of Search ..... 52/475, 656; 126/198, 126/200

[56] References Cited

U.S. PATENT DOCUMENTS

| | | | |
|---|---|---|---|
| 2,687,194 | 8/1954 | Kelly | 52/475 |
| 3,855,994 | 12/1974 | Evans et al. | 126/200 |

FOREIGN PATENT DOCUMENTS

| | | | |
|---|---|---|---|
| 1,146,290 | 11/1957 | France | 52/656 |
| 419,898 | 4/1947 | Italy | 52/656 |

*Primary Examiner*—John J. Camby

*Assistant Examiner*—Larry I. Schwartz

[57] ABSTRACT

The window unit is formed of a frame and of glass sheets arranged in spaced parallel relationship so as to form an air space between adjacent glass sheets; the frame is defined by top and bottom members and a pair of side members. The top and bottom frame members each have laterally spaced longitudinal portions forming channels and individually receive a major portion of the upper and lower marginal edges of the glass sheets. The side frame members each have recessed portions forming side channels to receive the side marginal edges of the glass sheets; each side frame member includes, at opposite ends thereof and between the side channels, outwardly projecting tongues extending between the channels of the top and lower frame members; the tongues are made of a material which is capable of being bent so that they may be folded over adjacent end portions of the top and bottom frame members to thereby lock the frame members in assembly with the glass sheets contained therein; air circulation through said unit is permitted by the spaces between the channels of the bottom and top frame members.

3 Claims, 7 Drawing Figures

WINDOW UNIT FOR USE IN OVEN DOORS

FIELD OF THE INVENTION

This invention relates to window units for use in oven doors and, more particularly, to the type of window units having one or more heat insulating spaces between the glass sheets.

BACKGROUND OF THE INVENTION

Present oven window units comprise two or more panes of glass mounted in a channel-like frame where each frame member must be accurately cut in accordance with the size and variations of a glass pane. Various types of gaskets must be provided to take up the free space which may be left between a frame member and its associated glass sheet which do not exactly fit one another.

OBJECTS OF THE INVENTION

It is an object of this invention to provide a window unit for use in an oven door having relatively few parts wherein the assembly of the frame members and of the glass sheets may be quickly and easily carried out.

A further object of the present invention is to provide an improved novel oven window unit including a frame made of two similar, preferably identical, side frame members and of two similar, preferably identical, top and lower frame members.

STATEMENT OF THE INVENTION

The present invention therefore relates to a window unit for use in an oven door which comprises, in combination: a frame, consisting of top and bottom members and a pair of side members, and glass sheets supported in the frame and arranged in spaced parallel relationship therein to define air spaces between adjacent glass sheets; said top and bottom frame members each having laterally spaced longitudinal portions forming channels to individually receive therein a major portion of the upper and lower marginal edges of the glass sheets, the top and bottom frame members each further including full end portions receiving the remaining portions of the marginal edges; said pair of side frame members each having recessed portions forming side channels to receive therein side marginal edges of the glass sheets; each side frame member including, at opposite end thereof and between the side channels, outwardly projecting tongues extending between the channels of the top and lower frame members; the tongues being made of a material capable of being bent so that the tongues may be folded over corresponding end portions of the top and bottom frame members to thereby lock the frame members in assembly with the glass sheets contained therein; air circulation through the unit being effected between the channels of the bottom frame member, up the air spaces between the glass sheets and between the channels of the top frame member.

Other objects and further scope of applicability of the present invention will become apparent from the detailed description given hereinafter; it should be understood, however, that the detailed description, while indicating a preferred embodiment of the invention, is given by way of illustration only, since various changes and modifications within the spirit and scope of the invention will become apparent to those skilled in the art from this detailed description.

DESCRIPTION OF PREFERRED EMBODIMENTS

Figures 1, 7:
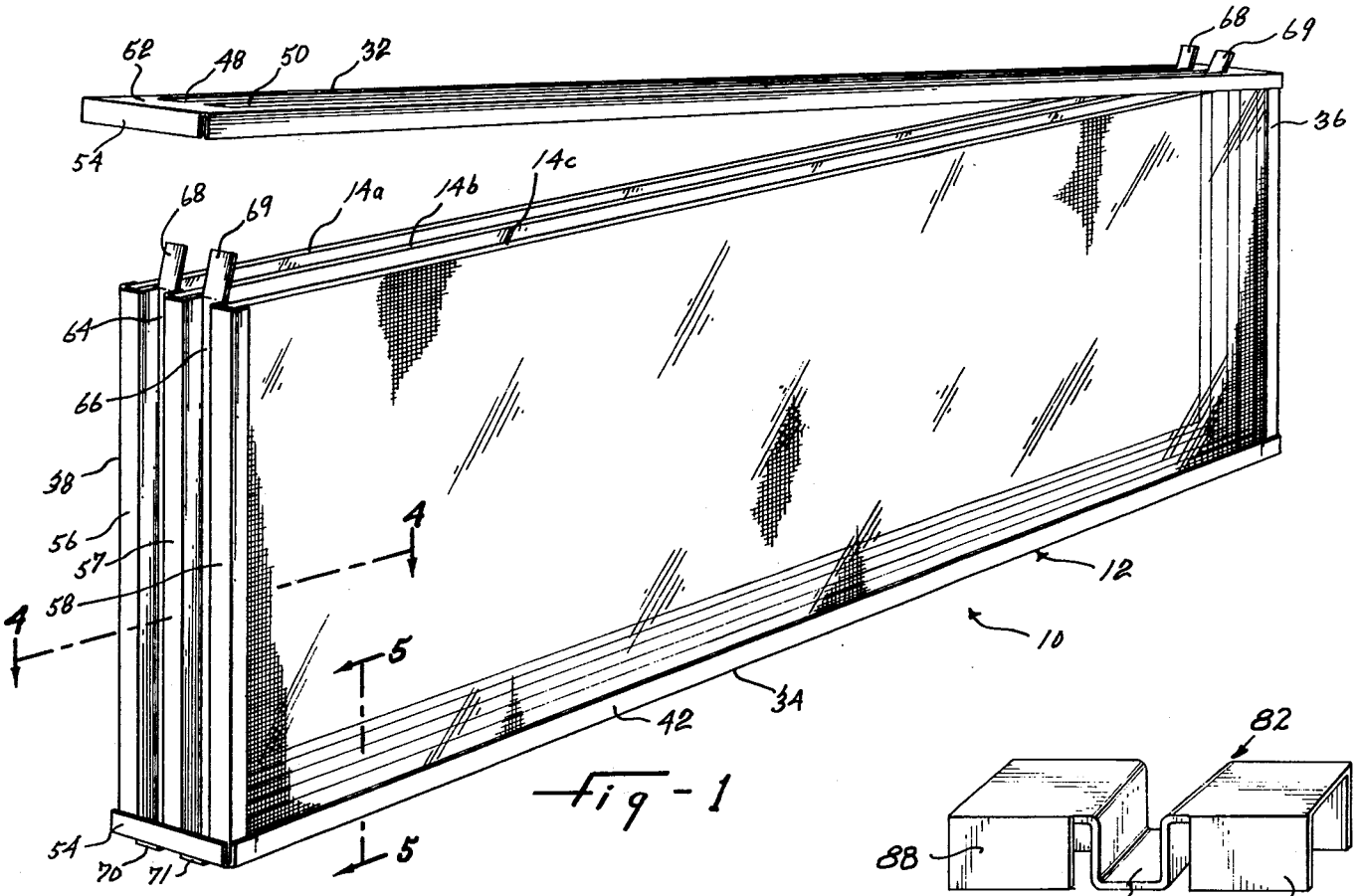
FIG. 1 is a perspective view of the window unit made in accordance with the present invention showing the top frame member in raised position.
FIG. 7 is a perspective view of a clamp used with a frame member made in accordance with the present invention.

Referring to FIG. 1, there is shown a window unit 10 made in accordance with the present invention consisting principally of a frame 12 and a plurality of glass sheets 14. The window unit shown includes three panes of glass; however, after having read the following description, it will be evident to the man skilled in the art that the present invention may easily be constructed for two or more glass sheets, without any difficulty.

Figure 3:
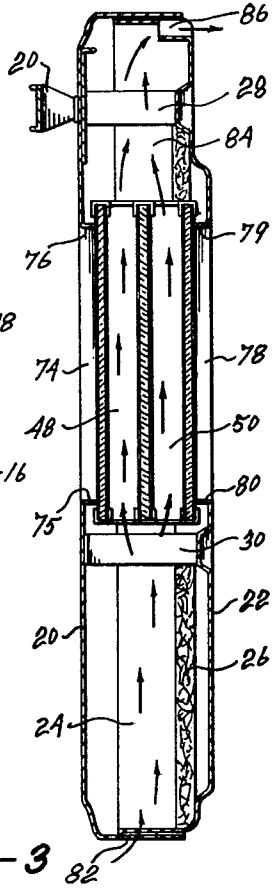
FIG. 3 is a cross-sectional view taken along lines 3—3 of FIG. 2.
Figure 2:
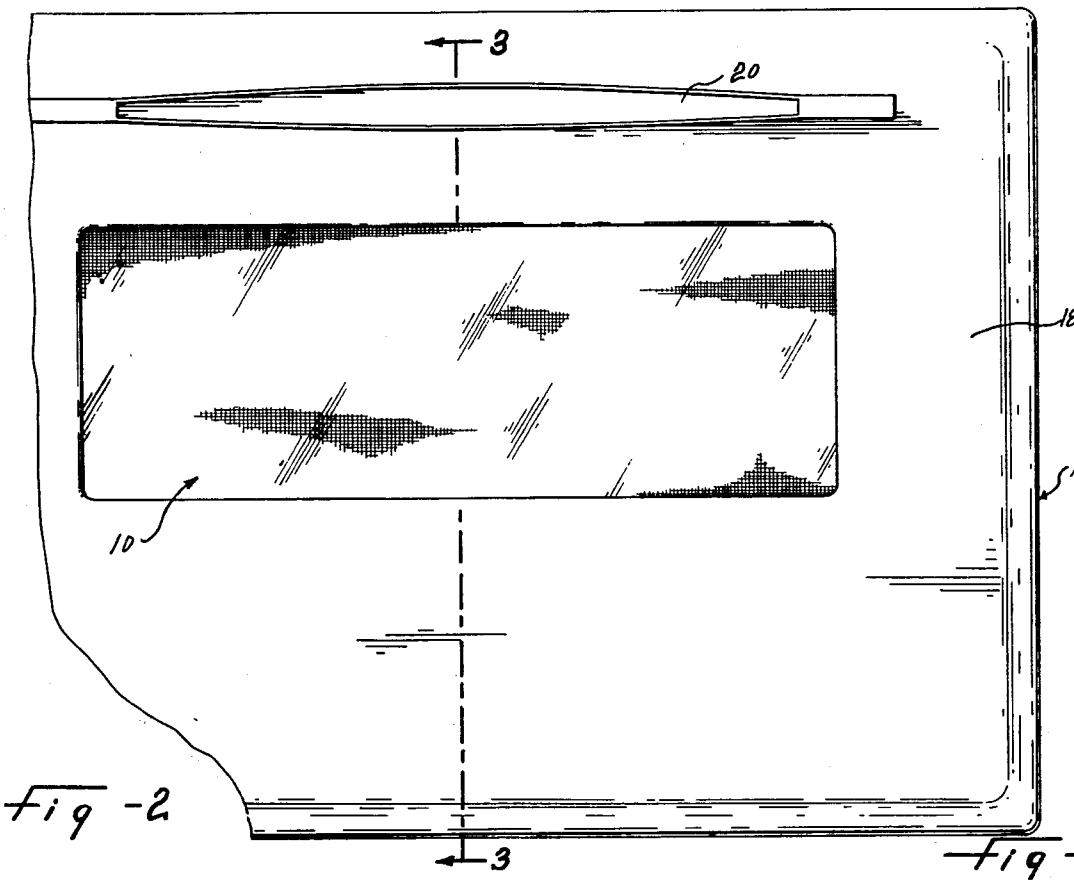
FIG. 2 is an elevational view showing partially the front of an oven door in which is mounted the window unit of FIG. 1.

Referring to FIGS. 2 and 3 of the drawings, the window unit 10 is mounted in an oven door 16 of the drop-type consisting of a front enamel rectangular sheet metal plate 18, having a handle 20, and a back lining plate 22 conventionally assembled to the front plate at a suitable distance therefrom to thereby define an air circulation passage 24 therebetween. An insulation batt 26 is disposed adjacent the back panel 22. Two spacer plates 28 and 30 provide rigidity between the two plates 20 and 22.

Referring to FIG. 1, the frame 12 comprises a top frame member 32, a bottom frame member 34 and two side frame members 36 and 38. In the present preferred form of the invention, the top frame member 32 and the bottom frame member 34 are identically constructed; similarly, the two side frames 36 and 38 are identical. Therefore, it will not be necessary to describe in detail the top frame member 32 after having described the lower frame member 34. For the same reason, only one side frame member will be described in detail.

Figure 6:
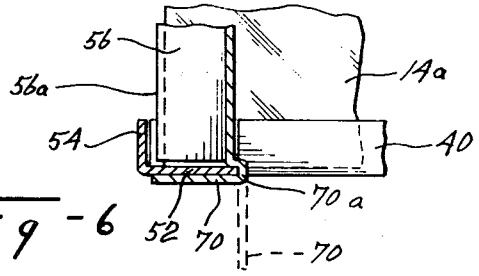
FIG. 6 is a cross-sectional view taken along lines 6—6 of FIG. 4.
Figure 5:
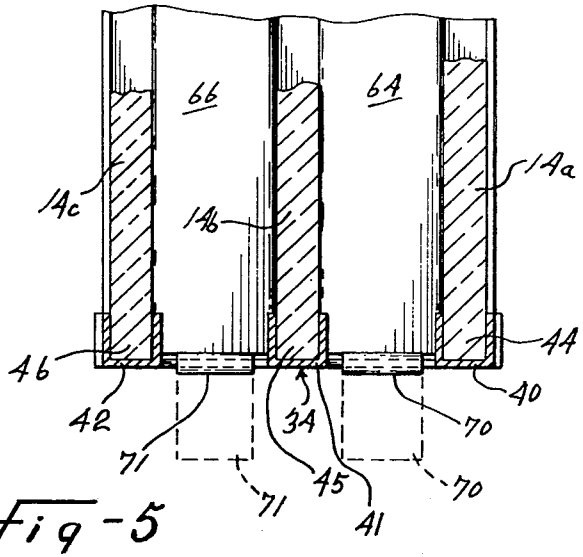
FIG. 5 is a cross-sectional view taken along lines 5—5 of FIG. 1.
Figure 4:
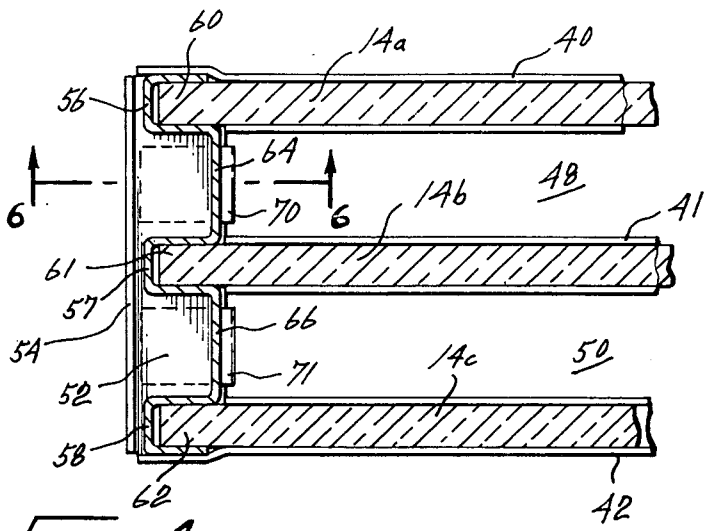
FIG. 4 is a cross-sectional view taken along lines 4—4 of FIG. 1.

Referring to FIGS. 4, 5 and 6, the lower frame member 34 includes three laterally spaced longitudinal portions 40, 41 and 42 that form channels to individually receive therein the lower marginal edges 44, 45 and 46, respectively, of glass sheets 14*a*, 14*b*, 14*c*. Between the longitudinal portions 40, 41 and 42 spaces 48, 50 are provided to allow air to penetrate and circulate between the glass sheets. The lower frame member 34 further includes at opposite extremities thereof full flat end portions (one of which is shown at 52 in FIG. 4) which serve to receive the opposite extremities of the lower marginal edges of the glass sheets and the lower portion of the side frame members. Each end portion 52 terminates with an upturned flange 54.

Side frame member 38 has three recessed potions 56, 57 and 58 that extend the entire length of the side member and which form side channels to receive therein the side marginal edges 60, 61 and 62 of glass sheets 14*a*, 14*b* and 14*c*, respectively. The side frame member 38 includes two intermediate portions 64, 66 which are disposed inwardly of edges 60, 61 and 62 of the glass sheets. Each side frame member includes at opposite end thereof and in the prolongation of portions 64, 66 a tongue 68, 69, 70, 71 which extends outwardly in space 48, 50 between channels 40, 41 and 42 of the lower and upper frame members.

To assemble the window unit 10, the marginal edges of glass sheets 14*a*, 14*b* and 14*c* are positioned in channels 40, 41 and 42 of the lower frame member 34 and in channels 56, 57 and 58 of both side frame members 36 and 38. Then, the top frame member 32 is placed over the glass sheets with channels 41 and 42 registering also with the marginal edges of the glass sheets. Tongues 68, 69, 70 and 71 at each end of both side frame members 36 and 38, which extend through corresponding spaces 48 and 50 of the top and bottom frame members, are folded over corresponding flat portions 52 of the upper and lower frame members 32 and 34.

Referring to FIGS. 4 and 6, an advantageous feature of the present invention is that variations in the longitudinal dimension of the glass sheets are permitted; it is not necessary for the outer wall of portions 56, 57, 58 to contact the inner wall of flange 54 in order to have a tight assembly. The connection of the side members with the top and bottom frame members is effected by the foldable tongues which do not have a predetermined folding line; the fold portion 70*a* (see FIG. 6) of each tong will vary in accordance with the distance separating flanges 54 and wall 56*a*. In all cases, however, a tight engagement between side frame members and bottom and top frame members is achieved.

The material used for the frame members must be sufficiently rigid but should allow some flexibility so as to allow a person to manually fold the tongues 68, 69, 70 and 71 over corresponding portions of the upper and lower frame members. Satisfactory results have been obtained with a 28 gauge pre-chromed steel.

Referring to FIG. 2 once the window is assembled, it is mounted in the door 16 between the inturned edges 74, 75, 76 of front plate 20 and edges 78, 79, 80 of rear plate 22.

The glass sheets are tempered glass panes of rectangular shape. In cases where the ratio of width to height is important, there may be provided at about the mid-portion of the upper and lower frame members, a transversely extending clamp 82 which will prevent inward and outward flexing of the glass sheets. This clamp includes a central U-shaped portion 84 which sits in the central channel 41 and two transversely extending spacer portions 86 and 88 which are respectively received in spaces 48 and 50 of frame member 34.

Air circulation through the door to reduce the temperature of the glass sheets is achieved through inlet ports 82 provided in the lower part of the door, up passage 24, between glass sheets 14 in spaces 48 and 50, via passage 84 to outlet port 86 provided in the upper part of the door.

What is claimed is:

1. A window unit for use in an oven door comprising, in combination:

a frame consisting of top and bottom members and a pair of side members; and glass sheets supported in said frame and arranged in spaced parallel relationship to define air spaces between adjacent glass sheets;

said top and bottom frame members each having laterally spaced longitudinal portions forming channels to individually receive therein a major portion of the upper and lower marginal edges of said glass sheets, said top and bottom frame members each further including full end portions receiving the remaining extremity portions of said marginal edges;

said pair of side frame members each having recessed portions forming side channels to receive therein side marginal edges of said glass sheets; each said side frame member including, at opposite ends thereof and between said side channels, outwardly projecting tongues extending between said channels of said top and lower frame members; said tongues being made of a material capable of being bent whereby said tongues may be folded over corresponding end portions of said top and bottom frame members to thereby lock said frame members in assembly with said glass sheets contained therein; air circulation through said unit being effected between said channels of said bottom frame member, up said air spaces between said glass sheets, and between said channels of said top frame member.

2. A window unit as defined in claim 1, wherein said top and bottom frame members are identically shaped and wherein said pair of side frame members are also identically shaped.

3. A window unit as defined in claim 1, wherein said glass sheets are rectangular in shape and wherein the horizontal dimensions of the glass sheets are substantially greater than the vertical dimensions of the glass sheets; further providing clamp means at about the mid portion of said upper and lower frame members to prevent inward and outward flexing of said glass sheets.

* * * * *